US008389092B2

(12) United States Patent
Andersson

(10) Patent No.: US 8,389,092 B2
(45) Date of Patent: Mar. 5, 2013

(54) STACK OF FOLDED MATERIAL

(75) Inventor: Anders Andersson, Stenungsund (SE)

(73) Assignee: SCA Hygiene Products AB, Gothenburg (SE)

( * ) Notice: Subject to any disclaimer, the term of this patent is extended or adjusted under 35 U.S.C. 154(b) by 241 days.

(21) Appl. No.: 13/054,575

(22) PCT Filed: Jul. 17, 2008

(86) PCT No.: PCT/SE2008/050881

§ 371 (c)(1),
(2), (4) Date: Jan. 18, 2011

(87) PCT Pub. No.: WO2010/008331

PCT Pub. Date: Jan. 21, 2010

(65) Prior Publication Data

US 2011/0129633 A1 Jun. 2, 2011

(51) Int. Cl.
*B32B 3/04* (2006.01)

(52) U.S. Cl. ..... 428/43; 428/124; 428/126

(58) Field of Classification Search ..... 428/43, 428/124, 126; 211/47, 48, 49
See application file for complete search history.

(56) References Cited

U.S. PATENT DOCUMENTS 6,257,410 B1 7/2001 Ulmann et al.
2005/0142336 A1 6/2005 Romano, III et al.

FOREIGN PATENT DOCUMENTS

WO 01/09023 A1 2/2001
WO 2007/081244 A1 7/2007

OTHER PUBLICATIONS

International Search Report, dated Apr. 1, 2009, from corresponding PCT application.

*Primary Examiner* — Alexander Thomas
(74) *Attorney, Agent, or Firm* — Young & Thompson

(57) ABSTRACT

A stack includes one or more web-shaped materials, at least one of the web-shaped materials having a visual pattern, wherein a similar pattern is seen as an edge pattern on a face side of the stack. There is also provided a method to produce such a stack.

22 Claims, 10 Drawing Sheets

STACK OF FOLDED MATERIAL

TECHNICAL FIELD

The present invention relates to a stack of folded material, such as paper or nonwoven. More particularly, it relates to a stack of tissue products such as toilet and kitchen paper, paper towels, handkerchiefs, wiping material and the like. The invention further relates to a method of forming a stack.

BACKGROUND OF THE INVENTION

Products made of web-shaped material, like paper or nonwoven, are traditionally used for a number of applications at home, in industry, office, public areas etc. Examples of such products are toilet paper, household towels, napkins, facial tissue, handkerchiefs, hand towels and wiping materials. Different applications place different demands on the product. In many cases, it is desired that the products have a pleasing visual appearance and/or a visual appearance that should communicate a message, e.g. the logotype of the company producing or selling the products.

It is well-known in the art to apply visually pleasing visible patterns on a web-shaped material in order to improve the visual appearance. The pattern may for example be printed or applied by using coloured adhesive.

For some of the above-mentioned products, the manufacturing comprises a step, wherein one or more of the web-shaped material is/are folded into stacks. Normally, there is also a preceding step, wherein the web-shaped material is divided into individual sheets by e.g. perforation lines or cutting lines. Examples of products that are normally sold in stacks are facial tissue, hand towels, wiping materials and napkins. Also toilet paper and household towels are sometimes sold in folded stacks. For this kind of products, there is normally no synchronization between an applied visible pattern and the distance between the folds or the sheet size. When the web-shaped material is folded into a stack, the sides of the stack constituted by the folds of the web-shaped material will therefore have an arbitrary pattern, which may impair the total visual appearance of the stack. Furthermore, since the applied visible pattern is often indicative of the type or function of the material from which the stack is made, this characteristic is not ascertainable when viewing the sides of the stack.

WO 01/09023 (The Procter & Gamble Company) discloses how a pattern, called indicia, can be applied to the end surfaces of a rolled paper product providing a functional benefit or an aesthetically-pleasing pattern. In an alternative embodiment a cut-and-stack configuration is described, e.g. facial tissue, with a pattern on at least one edge. It is also said that the planar surface of the sheets may be printed. In an embodiment shown in FIG. 2 of the document, the pattern on the end surface of the roll continues over the circumferential (or xy-) surface of the roll. The document further states that the indicia on the end surfaces could be aesthetically coordinated with the xy-surface print, e.g. the end surfaces could have small animals and the xy-surface large animals which match the small ones. According to the document WO 01/09023, the indicia are preferably applied to the end surfaces of the paper product by printing.

Since printing on the end surfaces implies an extra process step, the manufacturing will consequently be more complex and costly. In order to keep the "aesthetical coordination" between the xy-surface and the indicia at the end surfaces, the patterns of different application units, printing the xy-surface and end surfaces respectively, should be matched to each other from a pattern design point of view. If a pattern change is made, both the xy-pattern and the end surface pattern must be exchanged simultaneously.

There is therefore a need for a method, which in a more simple way can provide a visually pleasing product having a visually pleasing planar surface as well as visually pleasing sides of the stack. There is a further need for a product in the form of a stack, which stack is more readily identifiable.

SUMMARY OF THE INVENTION

It is therefore an object of the present invention to provide a stack which is more readily identifiable.

This object is achieved in accordance with the present invention by providing a stack according to the present invention. The stack is formed from an intermediate web, the stack having a first face side and a second face side, the first and second face sides facing in opposite directions, the first face side comprising a first plurality of edge portions formed by a first set of folds in the intermediate web and the second side face comprising a second plurality of edge portions formed by a second set of folds in the intermediate web, the edge portions having a thickness (t), the intermediate web comprising at least a first web-shaped material having a web extension direction, the first web-shaped material being provided with a first visible pattern having a repeat length (r) in the web extension direction of the first web-shaped material, wherein adjacent folds of the first set of folds are separated by a distance L in the web extension direction along the first web-shaped material, and adjacent folds of the second set of folds are separated by the distance L in the web extension direction along the first web-shaped material such that the distance L satisfies the equation:

$$L=n\cdot r+k\cdot t$$

where n is a positive integer, r is the repeat length, t is the edge portion thickness and k is a constant, with k being selected such that an edge pattern is formed on at least one of the first and second face sides of the stack, which edge pattern approximates the first visible pattern on the first web-shaped material.

By appropriate choice of k, an aesthetic effect of having a similar pattern to the first visible pattern on the first web-shaped material on at least one face side of the stack is achieved. This can for example be used when marketing and using such stacks, since it will be possible to visually ascertain what the stack contains without having to open the stack. The visual design is strengthened since a similar pattern is used both on the planar surface of the first web-shaped material and on at least one face side of the stack. Purely as an example, a user pulling a hand towel from an at least partly transparent or open dispenser, wherein the stack can be seen, will notice that his towel has the same pattern as the stack. The facilitator will easily be able to refill the dispenser with the same kind of stack again, since he/she sees from the outside of the stack what visible pattern has been used.

In one embodiment both face sides of the stack fulfil the equation $L=n\cdot r+k\cdot t$ as defined above. Both face sides may have the same set of parameter values for L, n, r, k, and t, i.e. they could have the same pattern. An example of both face sides having the same visible pattern is achieved by letting the first web-shaped material have a first visible pattern being visible from both sides thereof, e.g. applied by laminating two or more plies with a coloured adhesive. The two face sides may also have different sets of parameter values for L, n, r, k, and t, using e.g. a first web-shaped material with different printed patterns on its two sides or using an intermediate web comprising two or more web-shaped materials.

In a preferred embodiment the absolute value of the coefficient k (|k|) fulfils $0.5<|k|<2$, preferably $0.6<|k|<1.5$ and most preferably $0.8<|k|<1.2$. In an especially preferred embodiment the coefficient k is essentially equal to +1.

The coefficient n may be chosen to be an integer from 1 to 20, preferably from 1 to 10, and most preferably from 1 to 5.

Preferably, the first visible pattern comprises distinct decorative elements.

In a further embodiment, substantially all folds are substantially perpendicular to the web extension direction. The folds can be chosen to be substantially perpendicular to the machine direction of the first web-shaped material. Some of the edge portions may comprise separation lines, e.g. perforations and/or cuts, dividing the first web-shaped material into sheets.

In another embodiment, the majority of the visible edge portions is formed by a folded web-shaped material of the first web-shaped material, that is no separation line is visible from the outside of the stack.

The intermediate web may comprise two web-shaped materials, the first and a second web-shaped material, that are interfolded with each other. It is then possible to let the first web-shaped material form a first planar surface of the intermediate web and the second web-shaped material form an opposing second planar surface of the intermediate web, the first planar surface having the first visible pattern, the second planar surface having a second visible pattern, and each planar surface fulfilling $L=n\cdot r+k\cdot t$, as defined in claim 1, independent of the other planar surface.

In yet another embodiment, the intermediate web comprises separate sheets, having three, four or more panels, and wherein two consecutive separate sheets overlap each other by at least essentially one panel. In this respect, a panel is that part of a sheet located between a certain fold and its adjacent fold.

In a further embodiment, the first web-shaped material has a thickness of at least 200 μm, preferably at least 250 μm, and most preferably 300 μm. The first web-shaped material may be made of through-air-dried paper.

In a second aspect of the invention a method for producing visually pleasing stacks is provided: The method comprising the steps of:

- applying a first visible pattern to a first web-shaped material having a web extension direction, the first visible pattern having a repeat length (r) in the web extension direction of the first web-shaped material,
- forming an intermediate web from the first web-shaped material,
- folding the intermediate web in an accordion-like manner along a first set and a second set of folds extending in an edge direction being perpendicular to the web extension direction, the first set of folds forming a first plurality of edge portions of the first face side of the stack and the second set of folds forming a second plurality of edge portions of the opposite second face side of the stack, each fold of each set of folds being separated by a distance L in the web extension direction along the first web-shaped material, wherein the folding of the intermediate web is carried out such that the distance L satisfies the equation:

$$L=n\cdot r+k\cdot t$$

where n is a positive integer, r is the repeat length, t is the edge portion thickness and k is a constant, with k being selected such that an edge pattern is formed on at least one of the first and second sides of the stack, which edge pattern is perceived as similar to the first visible pattern on the first web-shaped material.

In one embodiment both face sides of the stack fulfil the equation $L=n\cdot r+k\cdot t$. In a preferred embodiment the absolute value of the coefficient k (|k|) fulfils $0.5<|k|<2$, preferably $0.6<|k|<1.5$ and most preferably $0.8<|k|<1.2$. In an especially preferred embodiment the coefficient k is essentially equal to +1.

In another embodiment of the second aspect of the invention a method is provided for forming a stack of two web-shaped materials. The method then further comprises the steps of:

- applying a second visible pattern to a second web-shaped material, the second visible pattern being similar to the first visible pattern or different,
- forming an intermediate web of the first and second web-shaped materials,
- interfolding the first and second web-shaped materials when folding the intermediate web, the first web-shaped material forming a first planar surface of the intermediate web and the second web-shaped material forming the opposing planar surface of the intermediate web, each of the planar surfaces thus having a visible pattern and fulfilling the equation $L=n\cdot r+k\cdot t$, independent of the other planar surface.

The methods described above may also comprise a further step:

- perforating or cutting the intermediate web at separation lines, wherein the distance between the separation lines is chosen to provide sheets of a suitable size. The separation lines can be located so that each sheet overlaps the following sheet by at least substantially one panel.

BRIEF DESCRIPTION OF THE DRAWINGS

The present invention will hereinafter be further explained by means of non-limiting examples with reference to the appended figures where.

DETAILED DESCRIPTION OF PREFERRED EMBODIMENTS

The invention will, in the following, be exemplified by embodiments. It should however be realized that the embodiments are included in order to explain principles of the invention and not to limit the scope of the invention defined by the appended claims.

Figure 3:
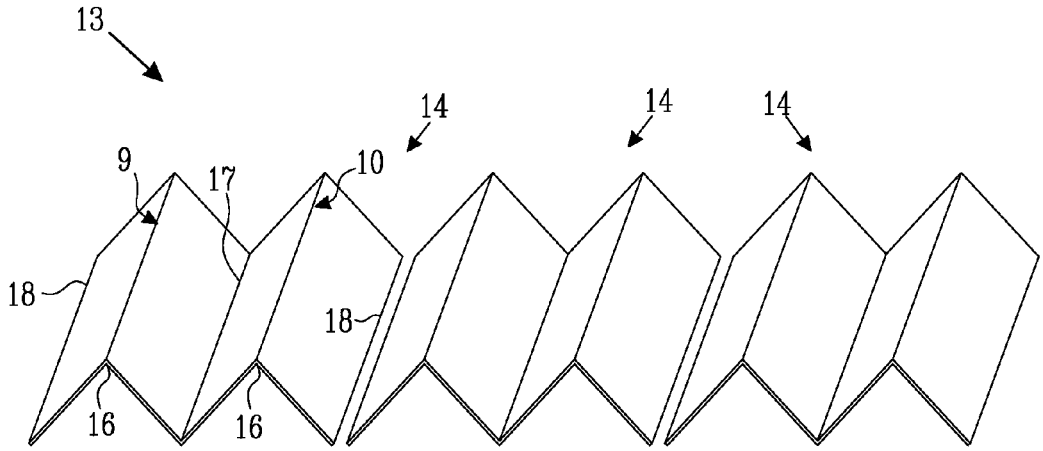
FIG. 3 shows, in a partly folded and divided state, an intermediate web which is used to form the stack of FIG. 1.
Figure 4:
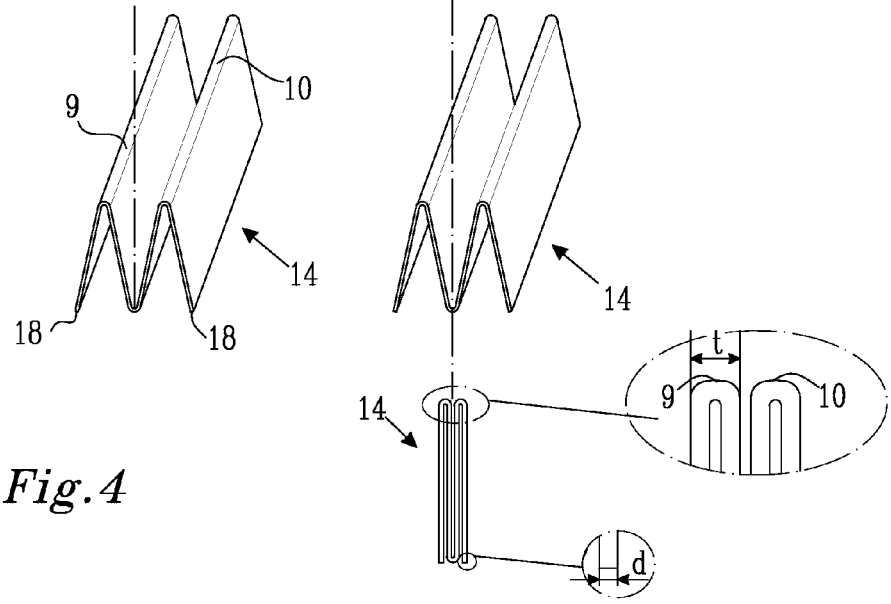
FIG. 4 shows a magnified part of the web of FIG. 3.
Figure 5:
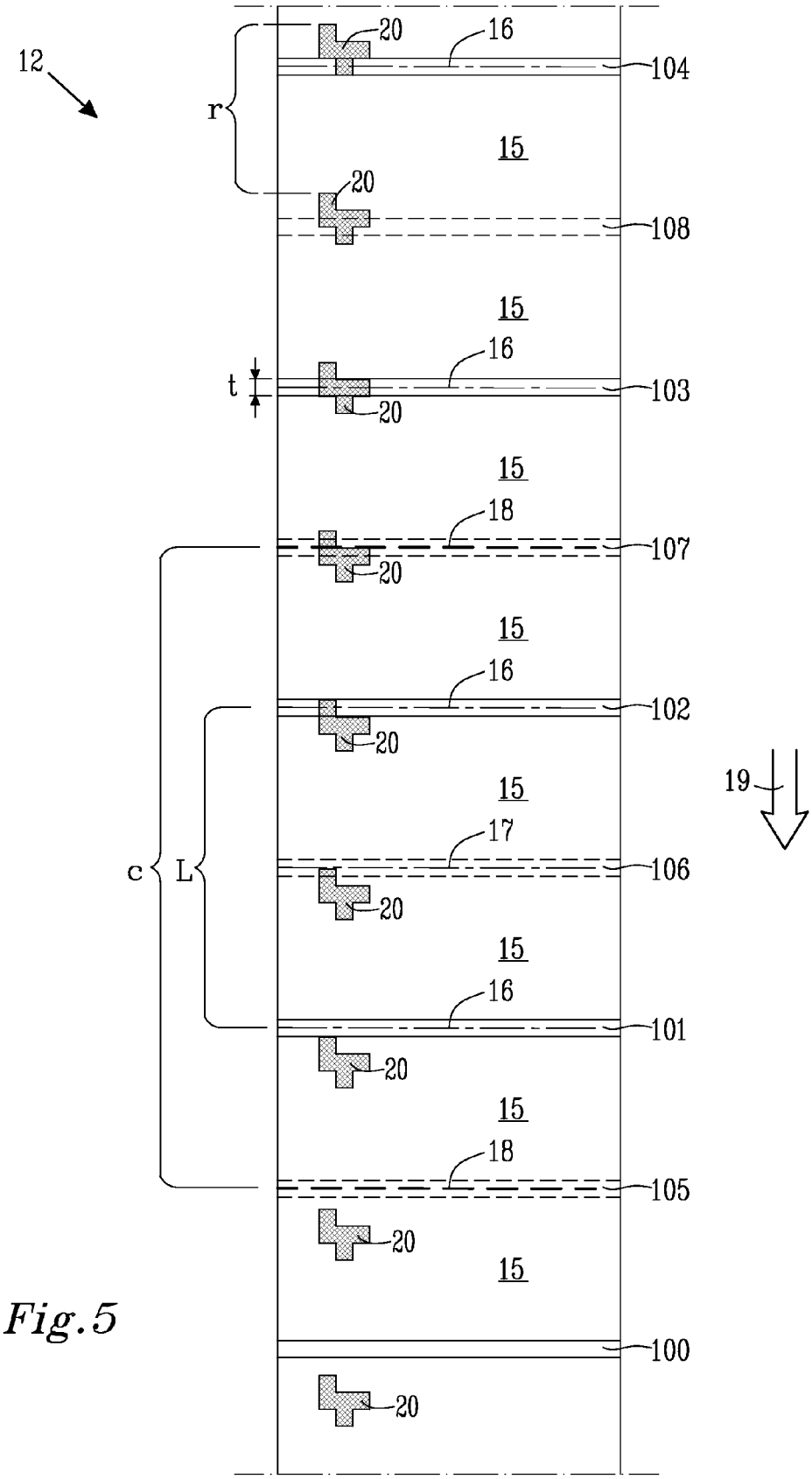
FIG. 5 shows a first web-shaped material for forming a stack according to a first embodiment of the invention.
Figure 6:
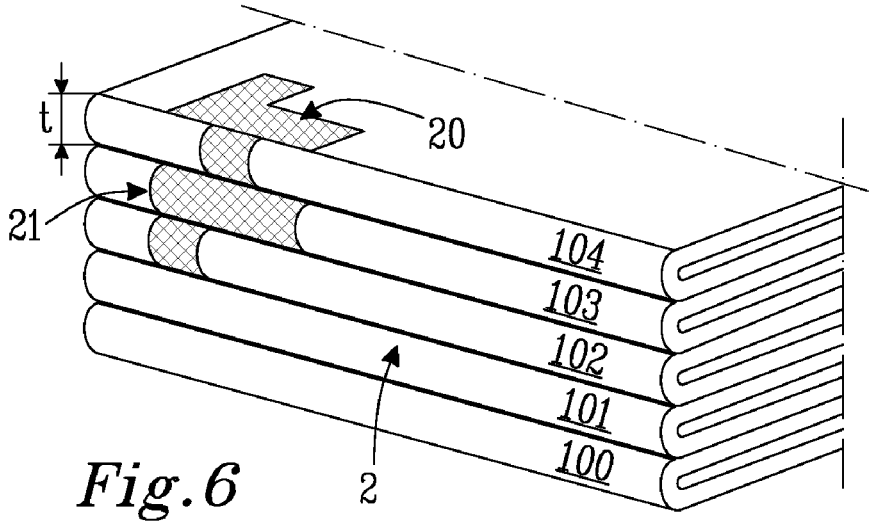
FIG. 6 shows a part of a stack formed of the first web-shaped material of FIG. 5.

FIGS. 1 to 4 illustrate the general principle of construction of a stack of a folded web-shaped material, while FIGS. 5 and 6 show a first embodiment according to the invention.

Figure 1:
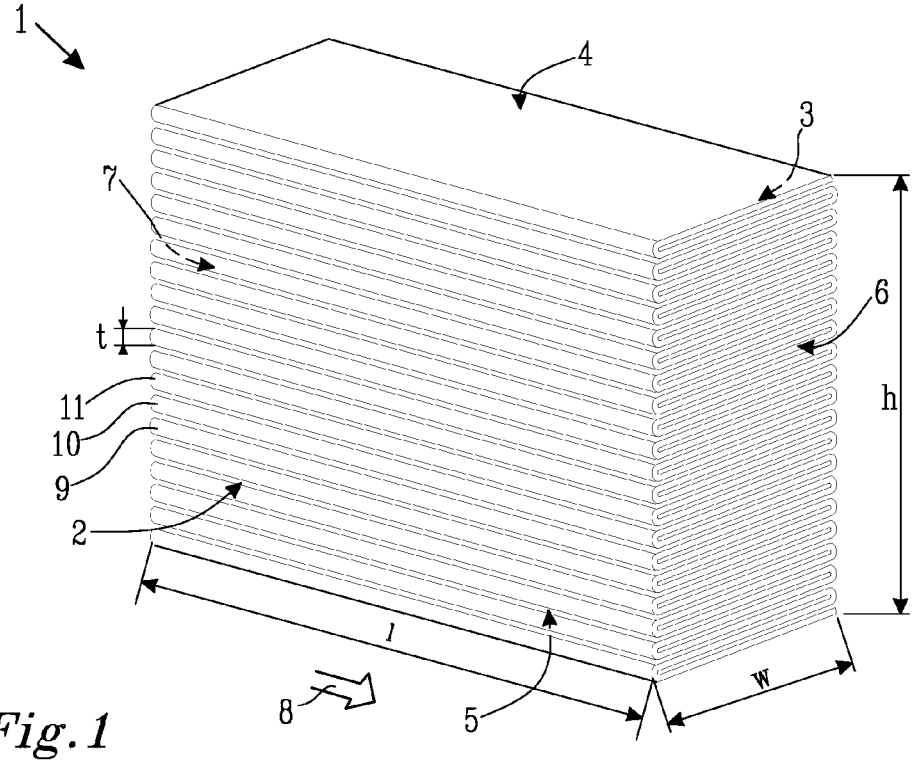
FIG. 1 is a schematic drawing of a stack comprising folded web-shaped material.

FIG. 1 shows an exemplary stack 1 formed from an intermediate web. The stack has two face sides, a first face side 2 facing forward in FIG. 1, and a second face side 3 opposite to the first face side 2. The stack further has a top side 4, a bottom side 5, a first end side 6, and a second end side 7 opposing the first end side 6. An edge direction, depicted by arrow 8, is defined as the direction which is in the plane of the first face side 2 and parallel to the top side 4. The first face side 2 comprises a first plurality of edge portions 9, 10, 11 formed by a first set of folds in the intermediate web and the second face side 3 comprises a second plurality of edge portions formed by a second set of folds in the intermediate web. Each such edge portion has a thickness t which normally corresponds to the thickness of a fold in a web (see FIG. 4). The stack has the dimensions: height h, defined as the distance between the top side 4 and the bottom side 5, width w between the face sides 2, 3 and length l between the end sides 6, 7. The edge portions 9, 10, 11 extend in the edge direction 8.

Herein the term "web-shaped material" is used for a web which extends in the machine direction of a production line. The web's length is considerably longer than its width. The web may be wound on a roll. Typical examples are webs of tissue paper or nonwoven. A web-shaped material can comprise one or more plies. In order to improve the visual appearance and/or to provide indicia indicative of the type or function of the material, a visible pattern can be applied to the web-shaped material. The web-shaped material is used as a raw material for making stacks of folded product.

For present purposes, the term "intermediate web" is used for a web just before the step of forming stacks. An intermediate web can comprise one, two or more web-shaped materials. If two or more web-shaped materials are used, they may be interfolded with each other, having sheet separation lines, e.g. cutting lines or perforation lines, which may be relatively displaced between the two or more interfolded web-shaped materials. An intermediate web can also comprise separate sheets partly overlapping each other. An intermediate web has two planar surfaces, each opposing the other.

Figure 2:
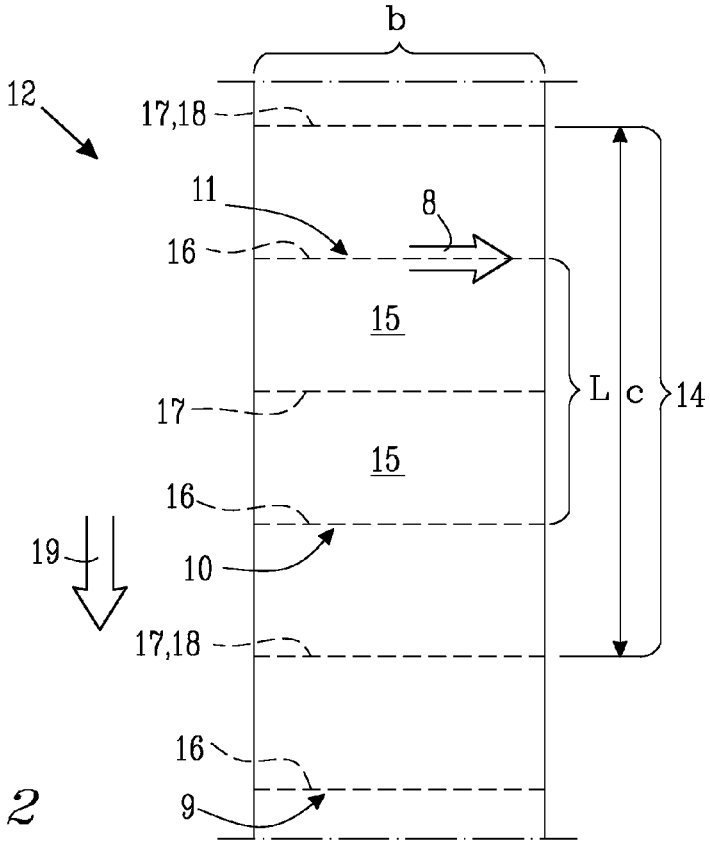
FIG. 2 shows the web-shaped material used to form the stack of FIG. 1.

The exemplary stack of FIG. 1 illustrates the simplest case wherein the stack is produced by folding a first web-shaped material 12 back and forth into panels in an accordion-like manner. In this example, the intermediate web is the same as the first web-shaped material 12. The first web-shaped material 12 is shown in FIG. 2 and the partly folded intermediate web 13 in FIG. 3. The intermediate web 13 comprises a number of sheets 14. The sheets 14 are also indicated in FIG. 2. A sheet 14 has a length c, in this case corresponding to four panels 15, and a width b, corresponding to the stack length l of FIG. 1. A panel is the part of a sheet located between a certain fold 16, belonging to e.g. the first set of folds, and its adjacent fold 17, belonging to the other set of folds. Adjacent folds of the first set of folds 16 are separated by a distance L in the web extension direction 19 along the first web-shaped material 12, and, in the same way, adjacent folds of the second set of folds 17 are separated by the distance L in the web extension direction 19 along the first web-shaped material 12. In this example, the distance L is the length of two panels 15. Since the intermediate web is folded like an accordion, every second fold 16 belonging to the first set of folds will be at the first face side 2 and its adjacent folds 17 belonging to the second set of folds at the second face side 3. As described above, each edge portion will have the thickness t corresponding to the thickness of a fold, in FIGS. 1-4 about twice the thickness of the intermediate web 13. The sheets are delimited from each other by separation lines 18, for example in the form of perforation lines. The web extension direction 19 is given by the extension of the first web-shaped material 12. The intermediate web extends in the same direction when it is still in a flat condition before being folded into a stack. It is further to be noted that the dimensions of a panel 15 is the same as that of the bottom 5 or top 4 side of the stack in FIG. 1. The web extension direction 19 is perpendicular to the edge direction 8.

As can be seen in FIG. 3, the intermediate web 13 is folded at the folds 16, 17. The folds are indicated by lines in FIG. 2 but in reality they have a certain width since the fold makes up the edge portions having the thickness t. A fold 16, 17 is substantially perpendicular to the web-extension direction 19. The term fold is herein used for actual folds, i.e. folds where the intermediate web is folded when forming the stack. There may, as well, be folds made earlier in the process but afterwards flattened out, but these are not regarded as folds.

An intermediate web 13 may be continuous, but in most cases it is discontinuous, i.e. divided into individual sheets. The division into sheets is done at the separation lines, for example cutting lines or perforation lines. In a cutting line, the intermediate web is cut through and the resulting sheets are not connected to each other. In a perforation line, the intermediate web is only partly cut through and the sheets are still partly connected to each other. A cutting line or a perforation line can be perpendicular or close to perpendicular to the web extension direction 19. For technical reasons, e.g. a cutting knife edge not impacting over the whole width of the web at the same time, the separation lines 18 may be localised to be a few degrees away from perpendicular. The cutting knife edge may have a straight or wavy profile.

In FIG. 3 the separation lines 18 are located at folds 17 of the second set of folds. A stack made of this intermediate web, having sheets comprising four panels, will thus have one face side, where every second edge portion comprises a fold with a separation line 18. The other edge portions, as well as the edge portions on the opposing face side, are made up of folds not comprising any separation lines. It would also be possible to locate the separation lines in between folds.

FIG. 4 shows two folded sheets from the intermediate web 13 of FIG. 3 next to each other. The magnification shows the thickness t of the edge portion 12. For clarity, the thickness d of the first web-shaped material and the thickness t of the edge portion are exaggerated in relation to the panel size. It is clearly seen that the thickness t of the edge portion is about twice the thickness d of the first web-shaped material. In the fold, the material of the intermediate web is partly compressed, making up the "inner" curve of the fold and partly elongated making up the "outer" curve of the fold.

A first embodiment according to the present invention is shown in FIGS. 5 and 6. In this embodiment, the first web-shaped material 12 makes up the intermediate web 13. FIG. 5 shows an example of the first web-shaped material 12 with a first visible pattern 20, which has been applied to the surface of the first web-shaped material in an earlier process step e.g. by printing or using a coloured adhesive. The intermediate web is intended to be folded back and forth to form a stack like the one described above. The first set of folds being bent forwards will form the first plurality of edge portions 100, 101, 102, 103, 104 at the first face side 2 of the stack. The second set of folds being bent backwards will form the second plurality of edge portions 105, 106, 107, 108 at the second face side 3 of the stack. The edge portions will have the thickness t when in the stack. The intermediate web is divided into sheets having the length c, corresponding to four panels. The separation lines 18 dividing the sheets are localised in every fourth fold 105, 107. In the stack illustrated in FIG. 6, the separation lines 18 will be at the second face side 3 (not shown in FIG. 6). The distance L in the web extension direction 19 along the first web-shaped material 12 between adjacent folds of the same set of folds 16 is, in this example, half of the sheet length c. The first visible pattern 20 is regular and has a repeat length r in the web extension direction 19. The repeat length r is defined by the distance along the first web-shaped material until the same pattern is repeated in the web extension direction 19.

In FIG. 6, the intermediate web 13 of FIG. 5 is shown as folded. Since the stack is seen from the first face side 2, the first plurality of edge portions 100, 101, 102, 103, 104 are visible. Each edge portion shows a part of the first visible pattern 20. In accordance with the invention, all these parts will together make up an edge pattern 21, which is seen on the first face side 2 of the stack 1. The edge pattern 21 approximates the first visible pattern 20 as seen on the first web-shaped material 12. For present purposes, the term "approximates" means that the edge pattern 21 need not be identical to the first visible pattern, but it will nevertheless be perceivable by an observer of normal intelligence and eyesight as being similar to the first visible pattern.

The first visible pattern 20 is preferably chosen to comprise decorative elements, like e.g. flowers, symbols or logotypes. The size of the decorative elements could be anywhere from a couple of millimetres to many centimetres. The visibility of the decorative elements can be enhanced by having distinct decorative elements with unpatterned surface in between the decorative elements.

A first visible pattern 20 comprising straight lines only extending in the web extension direction, would give a stack having a face side with straight lines. However, in such a pattern, there would not be a defined repeat length and the invention as defined by the claims would not be applicable.

Edge pattern 21 being similar to the first visible pattern 20 means that they are almost analogous patterns in shape. The edge pattern 21 could be somewhat stretched or compressed in the height direction h of the stack 1 (see FIG. 1) in relation to the first visible pattern 20 seen on the first web-shaped material. The edge pattern 21 may also be upside down in relation to the first visible pattern 20. Also, the edge pattern 21 could be somewhat less distinct than the first visible pattern 20. It is however possible to recognize the decorative elements of the first visible pattern 20 in the edge pattern 21. If the height h of the stack 1 is high enough, even a full pattern repeat, or more, of the applied first visible pattern 20 may be recognised from a face side of the stack.

In general terms the following equation is used when forming a stack according to the invention:

$$L=n\cdot r+k\cdot t \qquad \text{(Eq. 1)}$$

where

L is the distance L in the web extension direction along the first web-shaped material between adjacent folds of the same set of folds of the intermediate web, r is the repeat length of the first visible pattern in the web extension direction, n is a positive integer, k is a coefficient, and t edge portion thickness.

The coefficient k is chosen such that that the edge pattern 21 seen on a face side of the stack approximates the first visible pattern 20 on the first web-shaped material. If k is chosen to be +1 or −1 the edge pattern 21 will have the same size as the first visible pattern 20, as long as the stack is not compressed afterwards. The + or − sign influences the orientation of the pattern on the face side, where—will give a pattern which is upside down. $|k|>1$ will give a pattern which is compressed in the stack height direction, while $|k|<1$ will give a pattern which is elongated in the stack height dimension, and also somewhat blurred. It has been found that letting k be equal to +1, k=1, gives a very pleasingly aesthetical effect. The effects of different values for k are summarized in Table 1 below:

TABLE 1

The effects of different values for k.

| Value of k | Effect on the edge pattern 21 as compared to the first visible pattern 20 |
|---|---|
| k = 1 | The edge pattern will be the same as the first visible pattern, having the same size and orientation. Edge portions have correct orientation. |
| k = −1 | The edge pattern has the same size, but each edge portion will be "upside down" blurring the general impression. |
| 0 < k < 1 | The edge pattern will be elongated compared to the first visible pattern since portions of the pattern are shown at more than one edge portion. Results in some blurring. The blurring is worse close to 0 and disappears when approaching 1. |
| −1 < k < 0 | The edge pattern will be elongated compared to the first visible pattern since portions of the pattern are shown at more than one edge portion. Each edge portion "upside down". Both these effects result in blurring. |
| k > 1 | Edge pattern will appear compressed. Edge portions have correct orientation, but portions of the first visible pattern are not shown since k > 1. The further away from 1, the stronger is the effect. |

TABLE 1-continued

| The effects of different values for k. | |
|---|---|
| Value of k | Effect on the edge pattern 21 as compared to the first visible pattern 20 |
| k < −1 | Edge pattern will appear compressed. Edge portions are upside down. Portions of the first visible pattern are not shown since k > 1, so the blurring effect of edge portions upside down is less than for −1 < k < 0. |
| k = 0 | Straight lines at the face side if the applied pattern is located at the edge portion, otherwise no pattern at the face side. k = 0 implies that L = n · r, i.e. perfect fit between L and r. Not comprised by the invention. |

The effect of blurring depends on how detailed the first visible pattern 20 is. A simple pattern without fine details is easier to recognise as a similar edge pattern 21 and therefore k can deviate more from the preferred k=+1. For a simple pattern without fine details the direction of the edge portions are not critical and k=−1 will just give the impression that the edge pattern is turned upside down, but still similar to the first visible pattern.

Also how compressed or elongated the edge pattern 21 can be in relation to the first visible pattern 20 and still be perceived as similar depends on how simple or detailed the visible pattern is. It has been found that for commonly used visible patterns, such as logotypes or decorative elements, the absolute value of the coefficient k (|k|) should fulfil $0.5<|k|<2$, preferably $0.6<|k|<1.5$ and most preferably $0.8<|k|<1.2$.

The n is a positive integer. Normally n is quite low, from 1 to 20, preferably 1 to 10 and most preferably 1 to 5. With normal sheet sizes and panel sizes, values of n being higher than 20 would indeed fulfil Eq. 1, but it would be difficult to distinguish decorative elements.

The characterizing distances, L and r are defined as measured along the surface of the first web-shaped material 12 in the web extension direction 19. The first visible pattern 20 is applied to the first web-shaped material. If the intermediate web 13 is continuous or has sheets that follow after each other without overlaps, the distances will be the same when measured along the intermediate web 13 as along the first web-shaped material 12. However, if the intermediate web 13 comprises separate sheets, being cut from the same first web-shaped material and made to partly overlap, or sheets with a gap in between, which would be possible when combining a first and a second web-shaped material, the distances when measured along the intermediate web 13 will not be the same as along the web-shaped material.

The relative location of the edge portions to each other on the first web-shaped material 12 depends on the folding technology. In the case of using sheets partly overlapping each other, the distance between two consecutive edge portions of the intermediate web 13 is two panel widths. The distance L, which is measures on the first web-shaped material 12, depends on how much the sheets overlap. Purely as an example, if using three-panel sheets with one panel overlap, the distance L will be three panels. If instead there was a gap in between the sheets, the distance L would be less than two panels.

In the illustrated embodiment of FIGS. 5 and 6, the following relation is valid:

$$L=2\cdot r+(-1)\cdot t \qquad \text{(Eq. 2)}$$

The first visible pattern 20 repeats almost, but not exactly, twice between two consecutive edge portions 101, 102. The difference is (−1)·t, i.e. the coefficient k (see Eq. 1) is −1. Fulfilling Eq. 1 means that the first visible pattern 20 "moves" a little between an edge portion 101 and the next edge portion 102. In this embodiment, this "movement" corresponds to the thickness t of the edge portion. The parts of first visible pattern 20 which will appear on each edge portion form the constituent components of the edge pattern 21. The − sign in Eq. 2 means that the pattern 20 appears upside down, i.e. in reverse direction, when seen as the edge pattern 21 on the stack face side in FIG. 6 as compared to when seen on the intermediate web 13 and on the top of the stack in FIG. 6. The absolute value of k, |k|, equals 1 indicating that the edge pattern 21 on the face side has the same size as the pattern 20 of the first web-shaped material.

Figure 7:
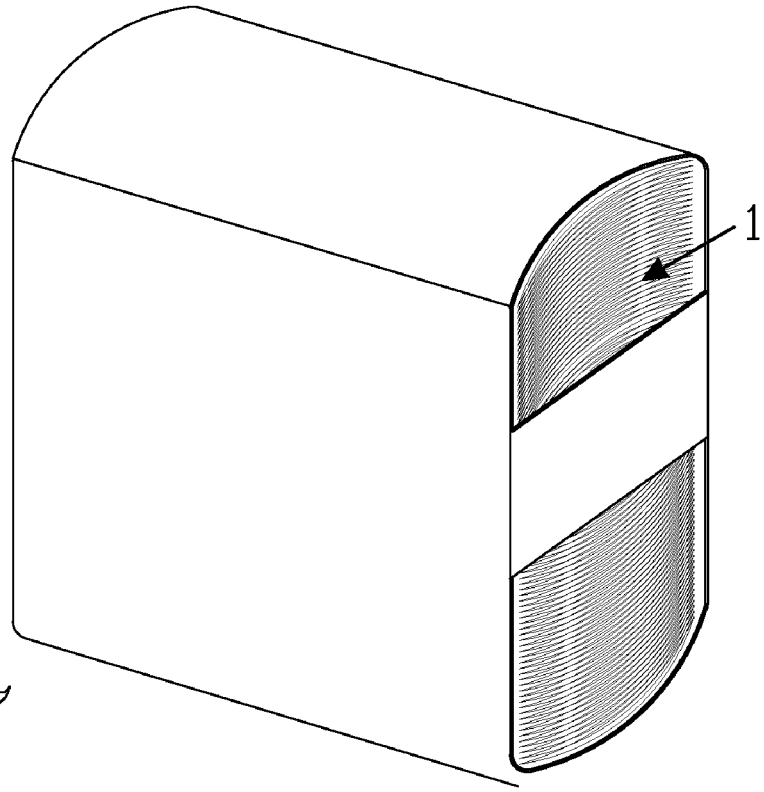
FIG. 7 shows a stack with curved top and bottom.

The stack of FIG. 1 is shown as having a substantially rectangular parallelepiped shape having a plane top side 4 and a plane bottom side 5. In reality, the stack will often have top and bottom sides that not are plane but instead have a curvature like in FIG. 7. However, that will not influence a pattern seen on the face sides of the stack.

It is a normal procedure in production to compress the stack so that it takes up less space and/or to obtain a predetermined number of sheets into a stack of a pre-determined size. The compression may compensate for variations in thickness of the first web-shaped material. The compression is performed in the height direction h of the stack. The edge pattern seen on the edge portions will therefore be compressed in the same direction, but will still be perceived as similar to the pattern seen on the intermediate web. The stack might be wrapped in a banderol to keep the compression, but when the banderol is released the stack has a certain spring-back and tends to increase its height again. If the stack is put in a dispenser, it might be compressed once again.

The first web-shaped material may comprise one, two, three or four or more plies. The plies may be similar or the first web-shaped material may comprise two or more plies having different properties, for example different grammage, different extensibility, different colour, different background embossing and/or different raw material. The web-shaped material can for example be made of absorbent material such as tissue paper or nonwoven. The plies can be attached to each other by methods known to the man skilled in the art, e.g. glue lamination, mechanical embossing, edge embossing and/or ultra-sonic embossing. The web-shaped material can have undergone other process steps before or after applying the visible pattern but before folding, such as embossing, spraying chemicals on the surface, e.g. lotion or wetting agents.

For present purposes, a tissue paper is defined as a soft absorbent paper having a basis weight below 65 g/m$^2$ and typically between 8 and 50 g/m$^2$. The greater the number of plies, the lower is generally the basis weight of each ply. A normal value for a ply in a multi-ply product is 10-25 g/m$^2$. Basis weight is measured according to standard ISO 12626-1: 2005. The density of the tissue paper is typically below 0.60 g/cm$^3$, preferably below 0.30 g/cm$^3$ and more preferably between 0.08 and 0.20 g/cm$^3$. Thickness is measured according to standard ISO 12626-3: 2005. Density is calculated from basis weight and thickness. The tissue paper may be creped or non-creped. Any creping may take place in wet or dry condition. The tissue paper can be through-air dried (TAD), and/or dried on a Yankee cylinder. The thickness of a tissue paper is typically between 50 and 600 μm when leaving the tissue paper machine. The lower end of the range may be reached for calendered dry-creped papers with low basis weight, while values at the higher end e.g. could be reached by an uncalendered TAD paper on a structured TAD fabric. Embossing is a well known and common way of increasing the thickness of a tissue paper.

The fibres contained in the tissue paper are mainly pulp fibres from chemical pulp, mechanical pulp, thermo mechanical pulp, chemo mechanical pulp and/or chemo thermo mechanical pulp (CTMP). The fibres may also be recycled fibres. When pulp fibres are used it is assumed that pulp fibres of all different kinds normally used in tissue manufacturing are comprised. Also other pulp of cellulose fibres can be used, like cotton linters, bast cells such as ramie, linen and jute, straw pulp, bamboo pulp, bagasse, sisal, rice straw and hemp. The tissue paper may also contain other types of fibres enhancing e.g. strength, absorption or softness of the paper. These fibres may be made from regenerated cellulose or synthetic material such as polyolefins, polyesters, polyamides etc.

For present purposes, a nonwoven material is defined as a manufactured sheet, web or batt of directionally or randomly orientated fibres, bonded by friction, and/or cohesion and/or adhesion, excluding paper, and products which are woven, knitted, tufted, stitch-bonded incorporating binding yarns or filaments, or felted by wet-milling, whether or not additionally needled. The fibres may be of natural or man-made origin. They may be staple or continuous filaments or formed in situ.

There are several ways of applying a visible pattern to a web-shaped material. One way is to print the web-shaped material by e.g. the flexographic process. For a multi-ply web-shaped material, one or more plies can be printed, either on the outside of the web-shaped material or on an internal surface in a web-shaped material having more than one ply. However, in order to achieve the desired visual effect the pattern should be visible from the outside, at least from one side of the web-shaped material, even when it is printed on an internal surface, so in that case the web-shaped material has to be at least somewhat transparent. The printing may be done in a separate process step or as part of a process also comprising a bundling process.

Another way of applying visible patterns is to use coloured adhesive when attaching the plies of a multi-ply web-shaped material to each other. Often lamination is combined with embossing. Suitable lamination processes are well-known to the man skilled in the art: nested, foot-to-foot, décor embossing and/or "goffra incolla"-lamination. The pattern should be visible from the outside of the web-shaped material, so the material should be at least somewhat transparent when using coloured adhesive. Normally, when using coloured adhesive for lamination, the pattern is visible from both external surfaces of the web-shaped material. A stack formed of such a material will consequently have edge patterns on both face sides of the stack.

The visible pattern may be just embossed, but if embossed, it is preferred to use a coloured adhesive to laminate plies in a multi-ply web-shaped material.

Different colours can be used, e.g. in 4-colour printing, combining coloured adhesive and print ink or by using more than one coloured adhesive.

The first visible pattern 20 is normally designed so that it should fit the circumference of a roll, e.g. a printing roll or an embossing roll. The pattern normally repeats an integer number of times. For runnability reasons, i.e. in order to run the printing roll and/or embossing roll as smoothly as possible, the pattern is normally designed so that the pattern subtends an oblique angle to the running direction of that roll. To achieve the object of the invention, the important repeat length is however the repeat in the web extension direction.

The colour repeat, i.e. the length in the machine direction until the same colour repeats, is normally the same as the pattern repeat. It is however also possible that the colour repeat is a multiple of the pattern repeat or vice versa. The colour may also be independent of the pattern repeat. If the colour repeat differs from the pattern repeat r and two colours or more are used, the edge pattern 21 may comprise edge portions 9, 10, 11 having different colours, which together build up the edge pattern 21.

It is preferred to use a web-shaped material that is relatively thick compared to standard tissue paper. This can be achieved by using a TAD paper, by embossing the paper to attain extra thickness, using multiple plies and/or by folding more than one web-shaped material onto each other.

Figure 8:
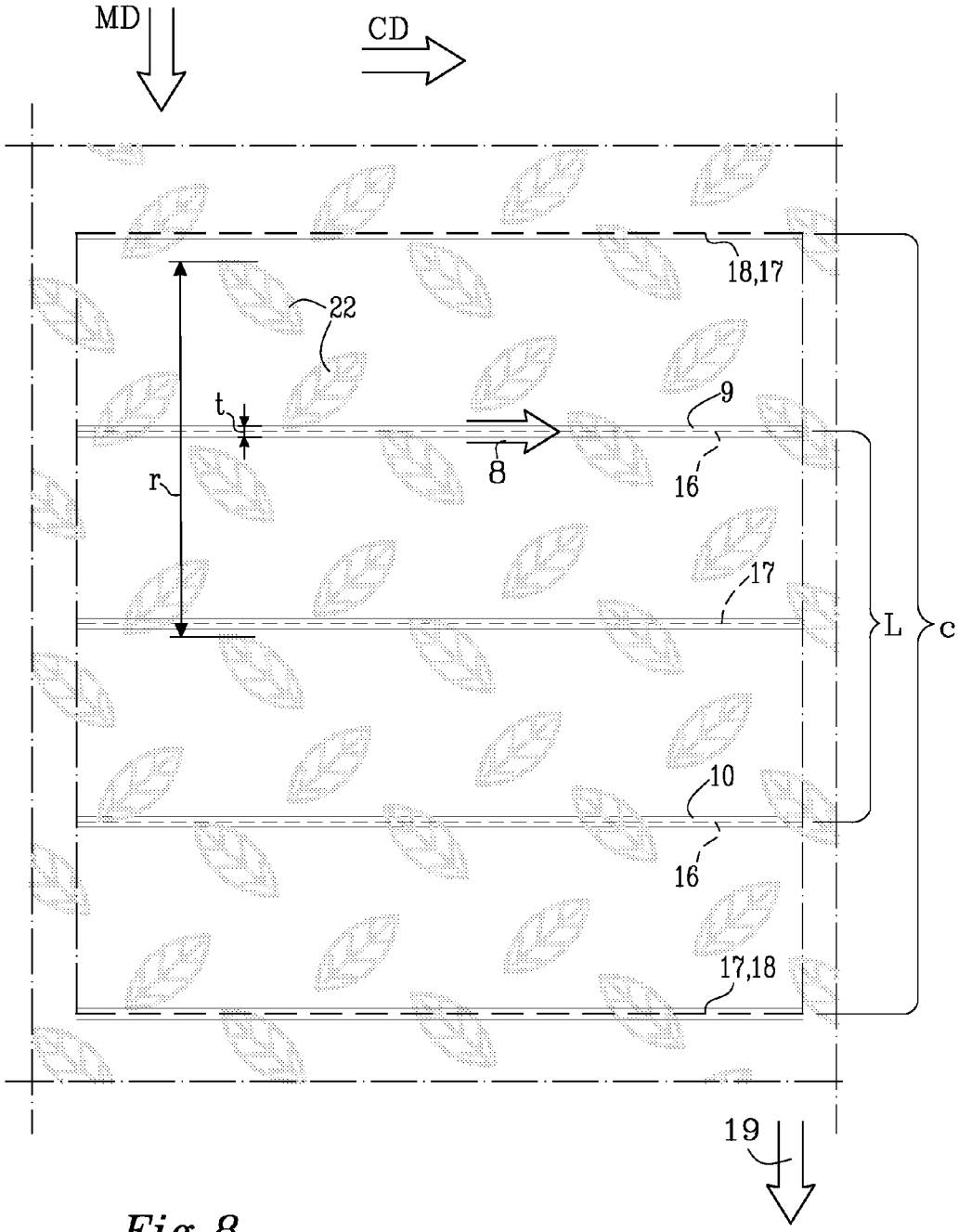
FIG. 8 shows a first web-shaped material having a first visible pattern.

In most cases the web extension direction 19 coincides with the running direction of the production line, the so-called machine direction. See for example FIG. 8, where the machine direction is denoted by MD. In FIG. 8, the decorative element 22 mimics a leaf. The edge direction 8 is perpendicular to the machine direction, i.e. parallel to the cross-machine direction CD. The example of FIG. 8 fulfils the equation:

$$L=1\cdot r+1\cdot t \qquad \text{(Eq. 3)}$$

so that n equals +1 and k equals +1. Comparing two consecutive edge portions 9, 10 of the first plurality of edge portions, the portion of the leaf seen at the edge portion has "moved" by a distance of t.

In FIG. 8, one sheet has a length c of four panels, and the sheet extend between two consecutive separation lines 18. The separation lines 18 are located at folds 17. The edges of the sheet are marked by dashed lines in FIG. 8. As can be seen, the longitudinal edges of the sheet, which are directed in the machine direction MD, intersect some of the leaves. When folding the intermediate web like an accordion a certain intersected leaf will repeat after r.

Figure 9:
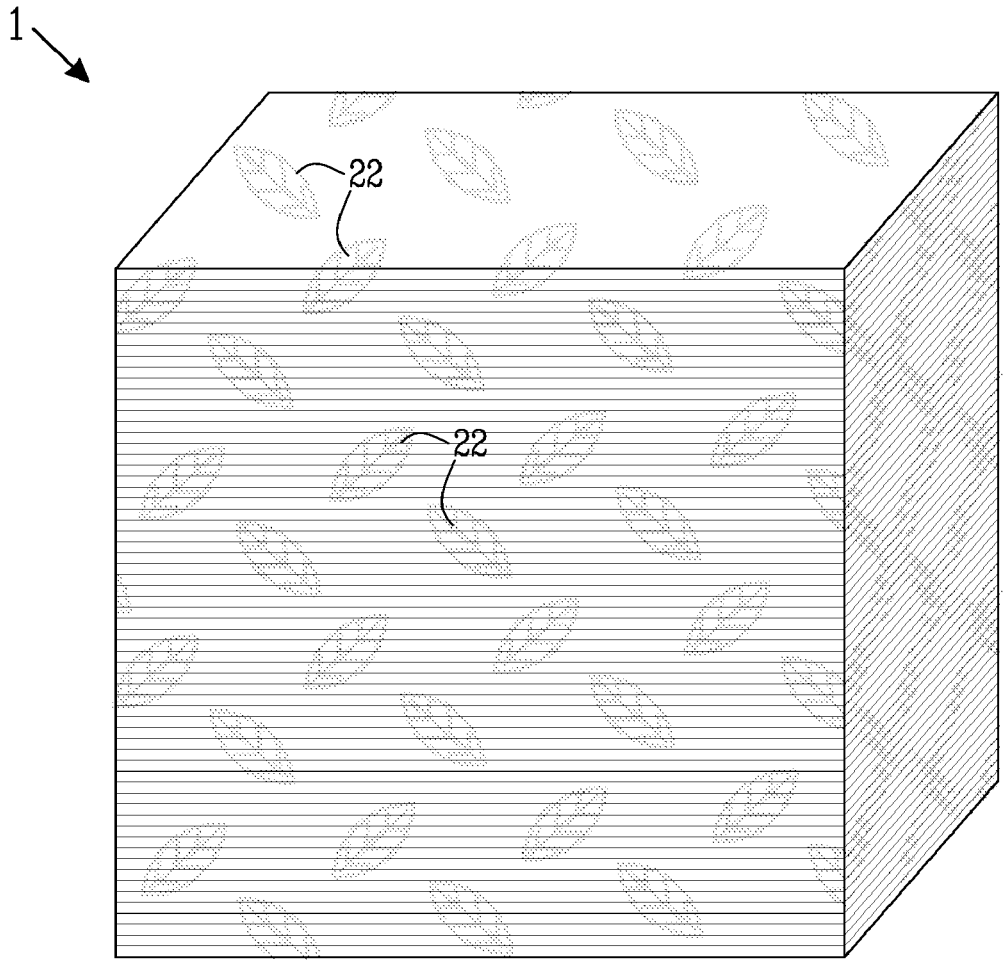
FIG. 9 shows schematically a stack made of the material of FIG. 8.

Moreover, it is noted that since, according to Eq. 3, the distance L is not equal to the repeat length r, the intersected leaf will move a little sideways when viewing a stack from one of the end sides 6, 7 as in FIG. 9. When viewing the stack from the end side 6, one layer will show an intersected leaf, the next layer no leaf, the following layer an intersected leaf displaced sideways by t, the next layer no leaf and the following layer an intersected leaf displaced by t. The end side will thus give a checked impression. The pattern of stripes seen at the end side will be related to the visible pattern by having the same colour but will not be perceived as similar.

The intermediate web, of which the stack is comprised, can be a continuous folded web, a perforated folded web, a web of separate sheets after each other, with or without a distance in between, or separate sheets partly overlapping each other. If the stack comprises separate sheets, they may be dispensed from the stack by letting one sheet "pull" the next by friction forces between the surfaces of the sheets.

FIGS. 1 to 9 show intermediate webs 13, wherein the individual sheets 14 are delimited from each other by separation lines. In this example, the separation lines are placed at folds, but the separation lines can instead be located outside the folds. The length of a sheet c can be independent of the panel size, although the sheet length is mostly a multiple of the panel size.

It is instead possible to have a folded web without separation lines. The delimitation into individual sheets could then be done manually by a user or with an arrangement in a dispenser, which is used to feed the web from the stack. The arrangement could for example comprise a straight or wavy knife edge for severing the web.

Figure 10:
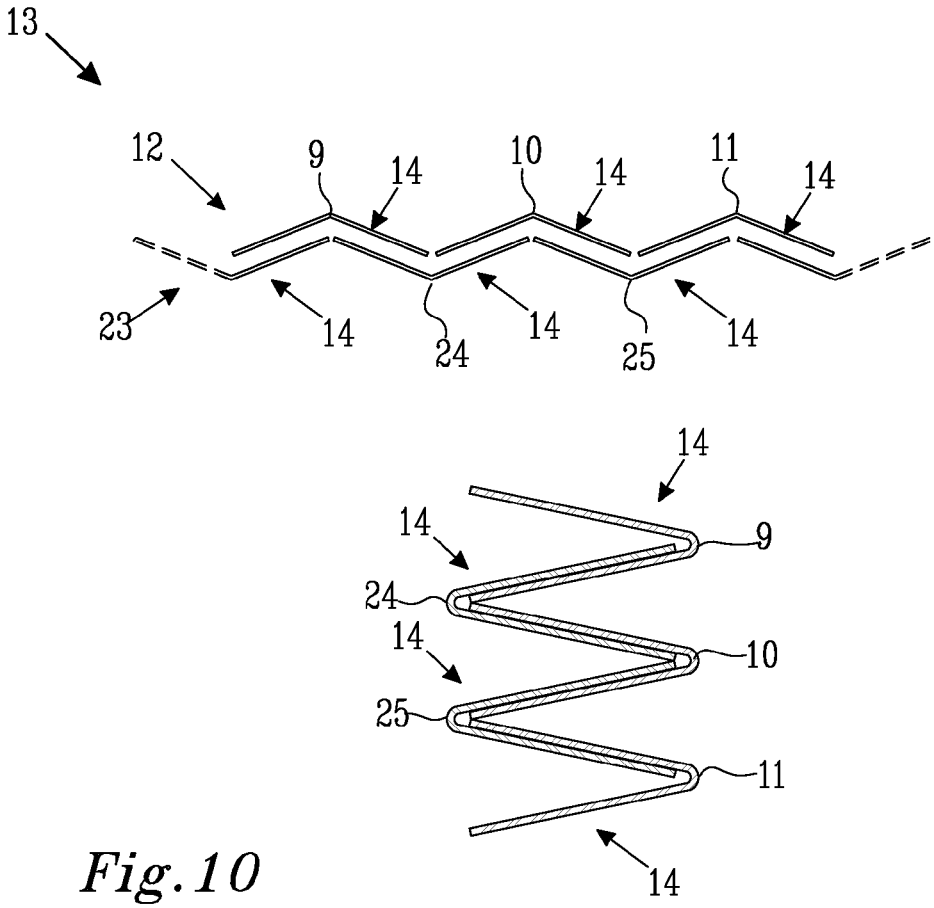
FIG. 10 shows an intermediate web used to form a stack according to a second embodiment of the invention.
Figure 11:
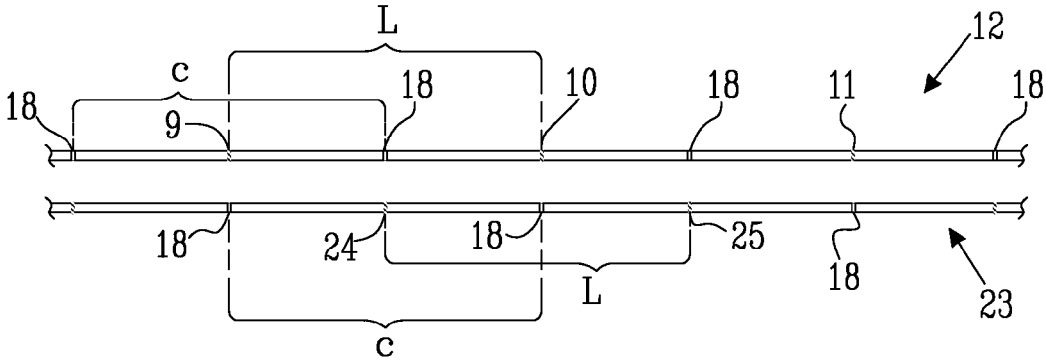
FIG. 11 shows the first and second web-shaped materials used for the intermediate web of FIG. 10.

FIGS. 10 and 11 show a second embodiment, wherein the intermediate web 13 of FIG. 10 comprises two web-shaped materials, a first web-shaped material 12 and a second web-shaped material 23, which are interfolded with each other. Individual sheets 14 can be separate or connected to the next sheet 14 in the same web-shaped material by a separation line. The web-shaped materials are positioned so that the sheets of one web-shaped material are partly overlapping with the sheets of the other web-shaped material, in this case by about half their lengths. The length of a sheet 14, denoted by c, is two panels. The sheets of the first web-shaped material 12 will form the edge portions 9, 10, 11 of one face side of the stack. The sheets of the second web-shaped material 23 will form the edge portions 24, 25 of the opposing face side of the stack. The distance L in the web extension direction along the first web-shaped material between adjacent folds of the same set of folds of the intermediate web is in this case the same as the sheet length c, and should fulfil Eq. 1 above. The second web-shaped material may also have a distance L fulfilling Eq. 1 above. In this embodiment with two interfolded web-shaped materials, the edge portion thickness t corresponds to two folds, one in the first web-shaped material 12 and one in the second web-shaped material 23, so the thickness t at the edge portion will be about four times the thickness d of an individual web-shaped material. In this example, all edge portions, except for the ones adjacent to the top side 4 and bottom side 5 of the stack, will comprise separation lines. The intermediate web 13 is however folded in such a way that the separation lines cannot be seen from the outside of the stack. FIG. 11 shows the two web-shaped materials in a flat condition.

Figure 12:
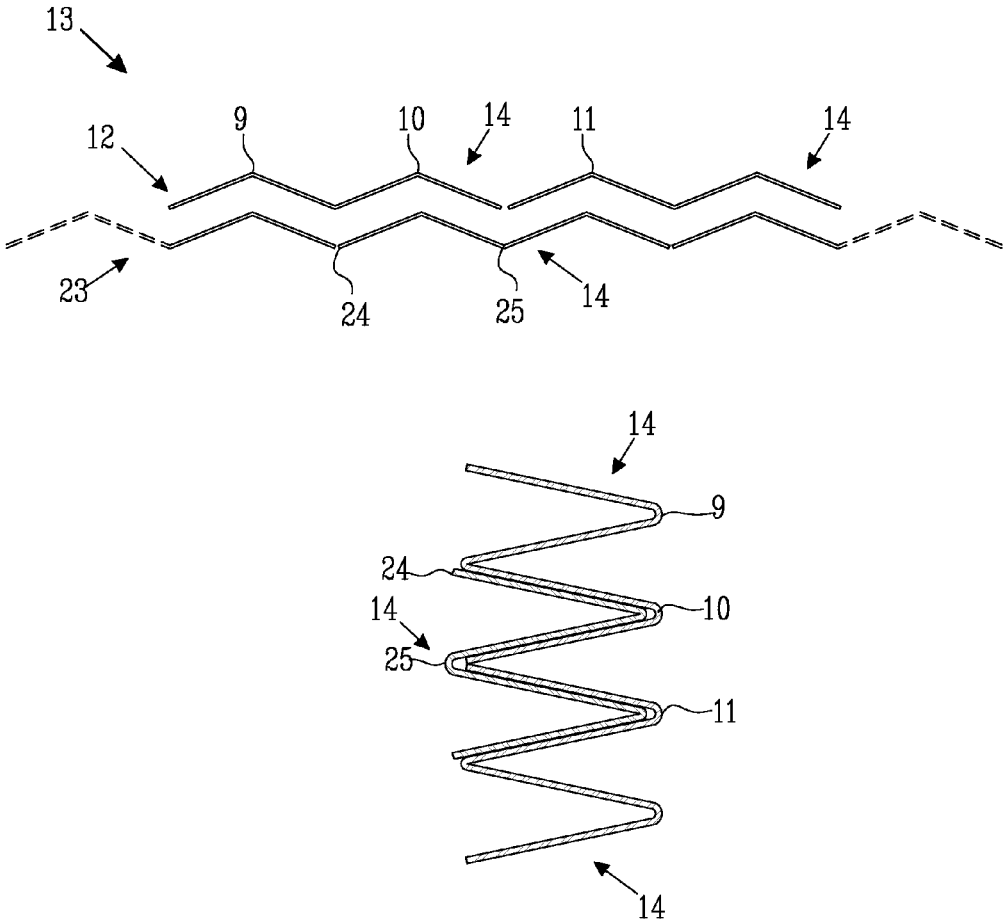
FIG. 12 shows an intermediate web used to form a stack according to a third embodiment of the invention.
Figure 13:
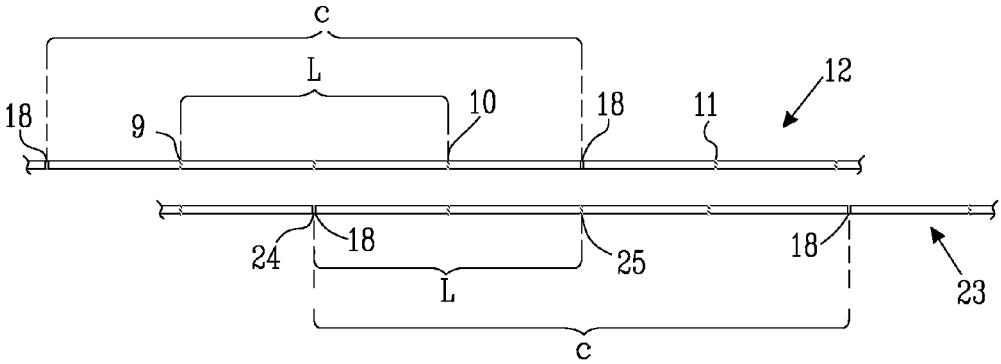
FIG. 13 shows the first and second web-shaped materials used for the intermediate web of FIG. 12.

In FIG. 12 a third embodiment is illustrated, wherein the intermediate web 13 comprises two interfolded web-shaped materials 12, 23. The sheet length c is four panels and the sheets 14 are separated by separation lines 18. The distance L in the web extension direction along the web-shaped material between adjacent folds of the same set of folds of the intermediate web is in this case two panels. Two consecutive edge portions 9, 10 on the same face side are therefore located on the same sheet 14. When the intermediate web 13 is folded, one face side will have all the edge portions of the first web-shaped material 12 and the other face side will have all the edge portions of the second web-shaped material 23. Every second edge portion 24 of the second web-shaped material 23 will be located on a separation line. A stack formed from the intermediate web will have one face side where the second web-shaped material 23 is visible and which has a separation line at every second edge portion, while the opposing face side of the stack where the first web-shaped material 12 is visible has no visible separation line, except for at the top and bottom of the stack. FIG. 13 shows the two web-shaped materials in a flat condition before folding.

In embodiments in which the intermediate web comprises two web-shaped materials, as in the second and third embodiment, a first visible pattern can be applied to the first web-shaped material 12 and a second visible pattern can be applied to the second web-shaped material 23, the second visible pattern being either similar to the first visible pattern or different. The intermediate web 13 is formed by combining the first 12 and second web-shaped materials 23, and interfolding them. The first web-shaped material 12 forms a first planar surface of the intermediate web 13 and the second web-shaped material 23 forms the opposing planar surface of the intermediate web 13, each planar surface thus having a visible pattern and each planar surface fulfilling Eq. 1, independent of the other planar surface. A stack formed by such an intermediate web has edge patterns 21 on both its face sides 2, 3. The edge pattern on the first face side 2 is formed by the first web-shaped material 12 and the edge pattern on the opposing second face side 3 formed by the second web-shaped material 23. Such a stack may also comprise one web-shaped material having a pattern and the other web-shaped material having no visible pattern.

Figure 14:
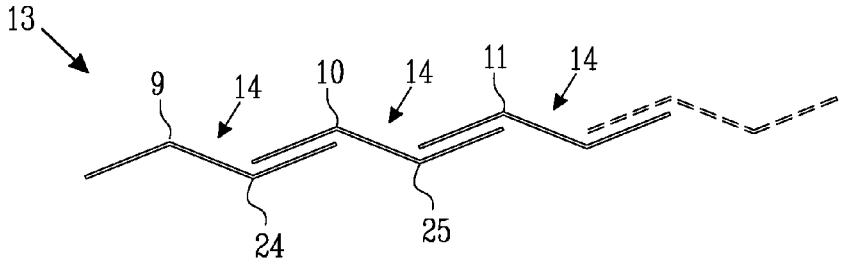
FIG. 14 shows an intermediate web used to form a stack according to a fourth embodiment of the invention.
Figure 15:
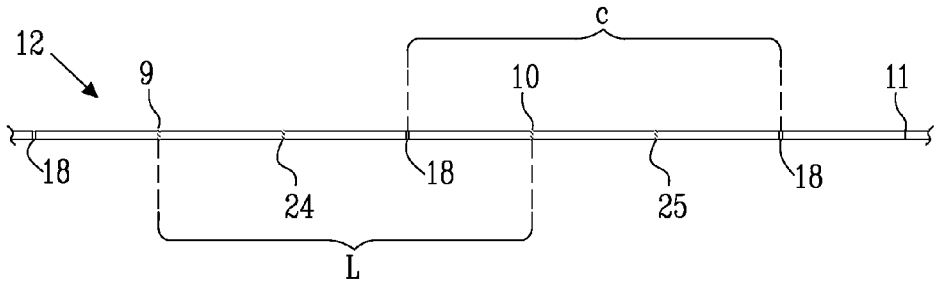
FIG. 15 shows the first web-shaped material used for the intermediate web of FIG. 14.

FIG. 14 shows a fourth embodiment, where the intermediate web 13 comprises separate sheets 14 that are partly overlapping in a so called "multi-fold" arrangement. In this example, a three-panel sheet is overlapping with one panel with both the sheet before and after. The edge portions 9, 10, 11 of the first plurality of edge portions on one face side of the stack are formed by the first fold in every sheet. The edge portions 24, 25 of the second plurality of edge portions on the other face side of the stack are formed by the second fold in every sheet. FIG. 15 illustrates the first web-shaped material 12. The distance L in the web extension direction along the first web-shaped material 12 between adjacent folds of the same set of folds of the intermediate web equals in the embodiment of FIGS. 14 and 15 three panels. In this embodiment, the sheet length c is also three panels.

Figure 16:
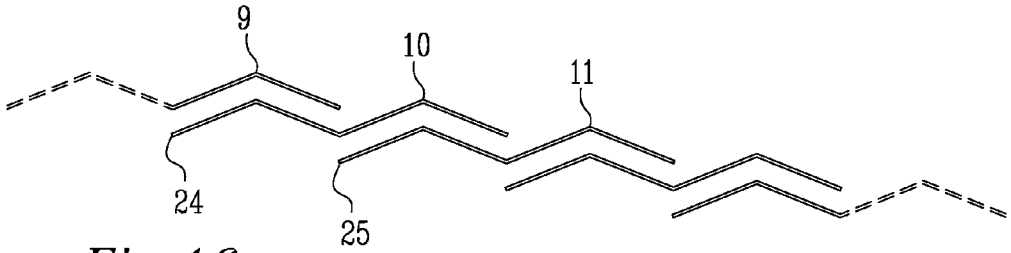
FIG. 16 shows an intermediate web used to form a stack according to a fifth embodiment of the invention.
Figure 17:
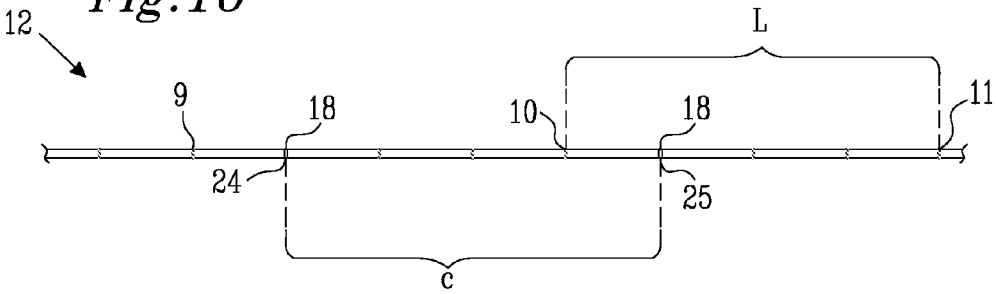
FIG. 17 shows the first web-shaped material used for the intermediate web of FIG. 16.

In a fifth embodiment, shown in FIGS. 16 and 17, a four-panel sheet is overlapping by two panels. The distance L in the web extension direction along the first web-shaped material between adjacent folds of the same set of folds of the intermediate web equals in the embodiment of FIGS. 16 and 17 four panels. In this embodiment, the sheet length c is also four panels.

Figure 18:
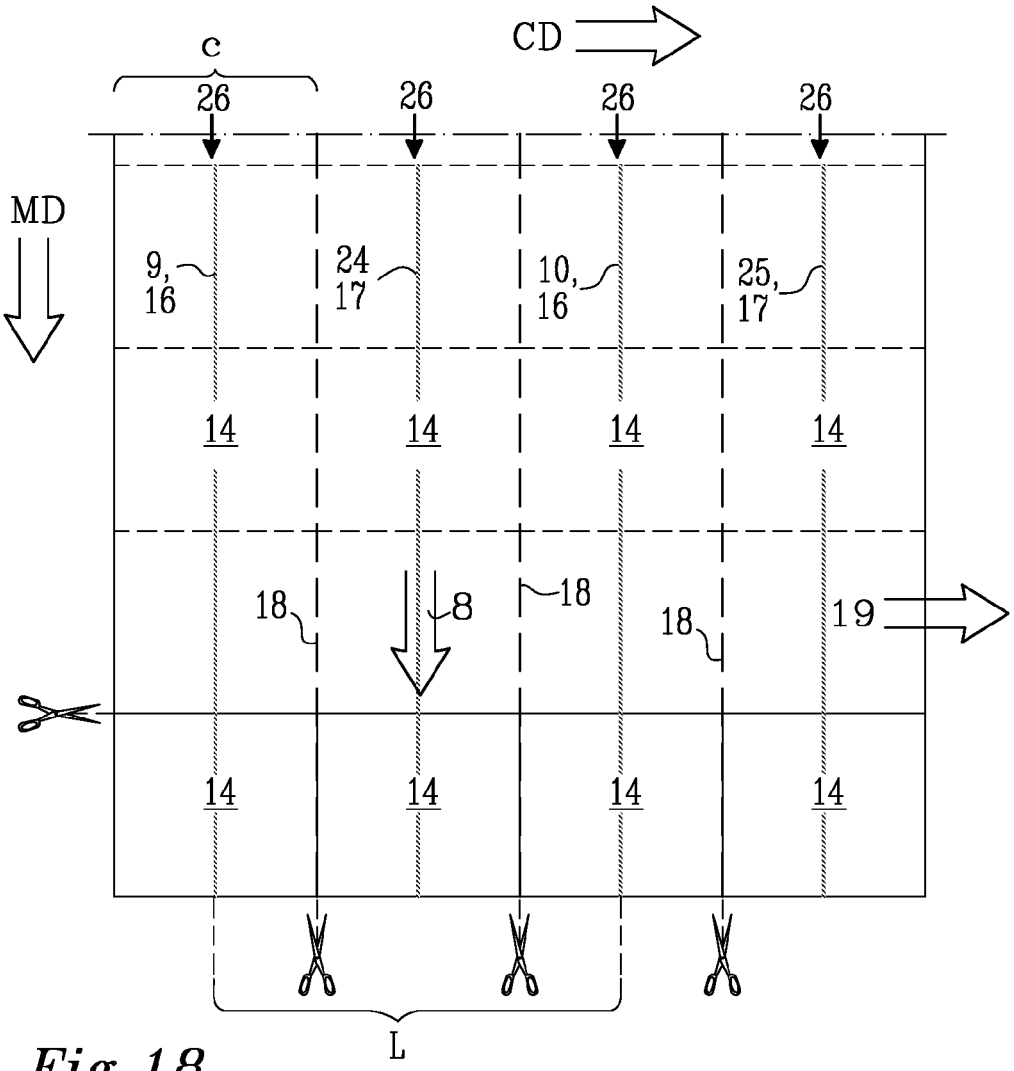
FIG. 18 shows a first web-shaped material used to form a stack according to a sixth embodiment of the invention.
Figure 19:
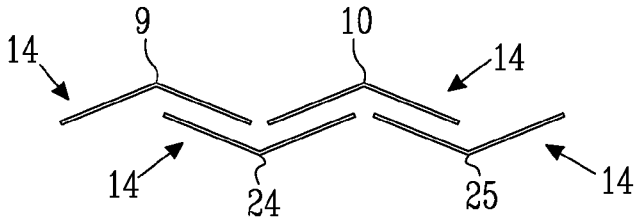
FIG. 19 shows the intermediate web made of the first web-shaped material of FIG. 18, It should be noted that the drawings have not been drawn to scale, and that the dimensions of certain features have been exaggerated for the sake of clarity. The same reference numbers are used in more than one figure to denote the same feature.

The first visible pattern 20 can also be designed to work for a length-fold converting line, i.e. a machine line making the folds along the running direction of the machine line. The web extension direction 19 is in that case perpendicular to the edge direction 8 and extends in the cross-machine direction CD as shown in the sixth embodiment in FIGS. 18 and 19. The ingoing web moving in the machine direction MD is split up into individual paths 24 at separation lines 18. Each path has a width which is the same as the sheet length c and is folded into two halves along a fold 16, 17, with each half having a width of about one panel. The individual paths are then positioned so that they overlap each other by a panel, resulting in interfolded sheets 14. All sheets have been formed from the same ingoing web. The distance L in the web extension direction along the first web-shaped material between adjacent folds of the same set of folds of the intermediate web is in this case four panels. The resulting stack, when folding the intermediate web 13, resembles the stack according to the second embodiment in FIG. 10. The man skilled in the art will understand that stacks like the ones of the third, fourth and fifth embodiment, as well as other variants, can be formed by varying how the paths 24 are folded and how they are located when placed on top of each other, In conventional converting machine lines, many process steps like printing, embossing, glue lamination and folding are made in the same line. The visible pattern is then applied in the same line as is also performing the folding operation. It is therefore possible for the machine control system to synchronize the visible pattern with the folding operation in such a way that Eq. 1 is fulfilled. The basic synchronisation of the visible pattern to the folds, in turn governing where the edge portions will be located, is done when the visible pattern is designed. When running the line, fine-tuning of the synchronisation can for example be done by adjusting the speed of the roll applying the visible pattern, normally in a printing unit or a glue application unit. Normally, the size of the panel is fixed, and therefore the application of the visible pattern on the first web-shaped material is adjusted to the folds and not vice versa.

When producing a product having separate sheets overlapping each other, like for example the fourth embodiment illustrated in FIGS. 14 and 15, a suitable production method is to apply the pattern to the first web-shaped material, fold the first web-shaped material into panels, cut the first web-shaped material into separate sheets and then retard the speed so that the sheets partly overlap each other, thereby forming the intermediate web, and finally form the stack of the intermediate web.

A favourable effect of the invention is achieved in a stack having very straight face sides. In real stacks, however, there will sometimes be some edge portions being located further out from the stack than the adjacent ones. Such edge portions will then take relatively more space and partly hide the adjacent edge portions. The edge pattern will still be visible but somewhat obscured; nevertheless, such a stack is also comprised by the invention.

The embodiments above illustrate several combinations of parameters, such as number of web-shaped materials, sheet sizes, pattern sizes, overlaps of sheets, localisation of folds, separation lines, etc, but the invention is not restricted to the illustrated embodiments. Instead, the man skilled in the art is at liberty to combine these parameters freely in many ways to create the products he desires within the scope of the appended claims.

The invention claimed is:

1. A stack formed from an intermediate web, said stack having a first face side and a second face side, said first and second face sides facing in opposite directions, said first face side comprising a first plurality of edge portions formed by a first set of folds in said intermediate web and said second side face comprising a second plurality of edge portions formed by a second set of folds in said intermediate web, said edge portions having a thickness (t), said intermediate web comprising at least a first web-shaped material having a web extension direction, said first web-shaped material being provided with a first visible pattern having a repeat length (r) in said web extension direction of said first web-shaped material, wherein adjacent folds of said first set of folds are separated by a distance L in the web extension direction along said first web-shaped material and adjacent folds of said second set of folds are separated by said distance L in the web extension direction along said first web-shaped material such that the distance L satisfies the equation:

$$L=n\cdot r+k\cdot t$$

where n is a positive integer, r is said repeat length, t is said edge portion thickness and k is a constant, with k being selected such that an edge pattern is formed on at least one of said first and second face sides of the stack, which edge pattern approximates said first visible pattern on the first web-shaped material.

2. The stack according to claim 1, wherein both face sides of said stack fulfil the equation $L=n\cdot r+k\cdot t$ as previously defined.

3. The stack (1) according to claim 1, wherein the absolute value of the coefficient k (|k|) fulfils $0.5<|k|<2$, and n is an integer from 1 to 20.

4. The stack according to claim 3, wherein the coefficient k is essentially equal to +1, and n is an integer from 1 to 10.

5. The stack according to claim 4, wherein n is an integer from 1 to 5.

6. The stack according to claim 1, wherein the first visible pattern comprises distinct decorative elements.

7. The stack according to claim 1, wherein substantially all folds are substantially perpendicular to the web extension direction.

8. The stack according to claim 1, wherein the folds are substantially perpendicular to a machine direction of the first web-shaped material.

9. The stack according to claim 1, wherein at least some of the edge portions comprise separation lines.

10. The stack according to claim 1, wherein the majority of the visible edge portions are formed by folded web-shaped material of said first web-shaped material.

11. The stack according to claim 1, wherein the intermediate web comprises two web-shaped materials including said first web-shaped material and a second web-shaped material, which are interfolded with each other.

12. The stack according to claim 1, wherein the intermediate web comprises two web-shaped materials, said first web-shaped material forming a first planar surface of the intermediate web and a second web-shaped material forming an opposing second planar surface of the intermediate web, said first planar surface having the first visible pattern, said second planar surface having a second visible pattern, and each said planar surface fulfilling $L=n\cdot r+k\cdot t$, as previously defined, independent of the other planar surface.

13. The stack according to claim 1, wherein the intermediate web comprises separate sheets, having three, four or more panels, and wherein two consecutive separate sheets overlap each other by at least essentially one panel.

14. The stack according to claim 1, wherein said first web-shaped material has a thickness (d) of at least 200 μm.

15. The stack according to claim 1, wherein said first web-shaped material is made of through-air-dried paper, and has a thickness (d) of at least 250 μm.

16. A method of forming a stack having a first visible pattern by folding an intermediate web, said stack having a first face side and a second face side, said first and second face sides facing in opposite directions, each of said face sides comprising a plurality of edge portions formed by folds in said intermediate web, said edge portions having a thickness (t), said method comprising the steps of:

applying said first visible pattern to a first web-shaped material, having a web extension direction, said pattern having a repeat length (r) in the web extension direction of said first web-shaped material, forming said intermediate web from said first web-shaped material, folding said intermediate web in an accordion-like manner along a first set and a second set of folds extending in an edge direction being perpendicular to the web extension direction, said first set of folds forming said plurality of edge portions of the first face side of said stack and said second set of folds forming said plurality of edge portions of the opposite second face side of the stack, each fold of each set of folds being separated by a distance L in the web extension direction along said first web-shaped material wherein said folding of said intermediate web being carried out such that the distance L satisfies the equation:

$$L=n\cdot r+k\cdot t$$

where n is a positive integer, r is said repeat length, t is said edge portion thickness and k is a constant, with k being selected such that an edge pattern is formed on at least one of said first and second sides of the stack, which edge pattern approximates said first visible pattern on said first web-shaped material.

17. The method according to claim 16, wherein both face sides of said stack fulfil $L=n\cdot r+k\cdot t$ as previously defined.

18. The method according to claim 16, wherein the absolute value of the coefficient ($|k|$) fulfils $0.5<|k|<2$.

19. The method according to claim 18 wherein the coefficient (k) is essentially equal to +1.

20. The method according to claim 16, further comprising the steps of:

applying a second visible pattern to a second web-shaped material, said second visible pattern being similar to said first visible pattern or different, forming the intermediate web of said first and second web-shaped materials, interfolding said first and second web-shaped materials when folding the intermediate web, the first web-shaped material forming a first planar surface of said intermediate web and the second web-shaped material forming the opposing planar surface of said intermediate web, each of said planar surfaces thus having a visible pattern and fulfilling the equation $L=n\cdot r+k\cdot t$, as previously defined, independent of the other planar surface.

21. The method according claim 16, further comprising the step of:

perforating or cutting the intermediate web at separation lines, wherein the distance between separation lines is chosen to provide sheets of a suitable size.

22. The method according to claim 21, wherein the separation lines are located so that each sheet overlaps the following sheets by at least about one panel.

* * * * *